US006079870A

United States Patent [19]

Krzywdziak

[11] Patent Number: 6,079,870

[45] Date of Patent: Jun. 27, 2000

[54] HEIGHT LOCATING WASHER FOR THE STIRRER SHAFT OF A STIRRER LID FOR A PAINT STIRRING MACHINE

[75] Inventor: Alain Krzywdziak, Orleans, France

[73] Assignee: F.A.S., Orleans, France

[21] Appl. No.: 09/157,193

[22] Filed: Sep. 18, 1998

[30] Foreign Application Priority Data

Sep. 19, 1997 [FR] France ..... 97 11683

[51] Int. Cl.[7] ..... B01F 11/00

[52] U.S. Cl. ..... 366/242; 366/244; 366/347; 366/605

[58] Field of Search ..... 366/605, 247, 366/244, 242, 347; 403/108; 248/219.3; D8/399, 396; D20/23

[56] References Cited

U.S. PATENT DOCUMENTS

| | | | |
|---|---|---|---|
| D. 33,557 | 11/1900 | Lyman | D8/399 |
| D. 34,541 | 5/1901 | Williams | D8/399 |
| D. 80,435 | 7/1930 | Way | D20/23 |
| D. 375,894 | 11/1996 | Ogawa | D8/396 |
| 2,452,923 | 11/1948 | Graff . | |
| 2,484,401 | 10/1949 | Coie | 403/108 |
| 3,132,850 | 5/1964 | Puchalski . | |
| 4,561,782 | 12/1985 | Jacobsen et al. . | |
| 4,917,003 | 4/1990 | Kollross | 403/108 |
| 5,005,843 | 4/1991 | Markle et al. . | |
| 5,199,788 | 4/1993 | Stallings | 366/605 |
| 5,800,057 | 9/1998 | Lesimple | 366/605 |

FOREIGN PATENT DOCUMENTS

WO 97/11973 4/1997 WIPO .

*Primary Examiner*—Tony G. Soohoo

*Attorney, Agent, or Firm*—Scully, Scott, Murphy & Presser

[57] ABSTRACT

The invention relates to a height locating washer for the stirrer shaft of a stirrer lid for a paint stirring machine. This washer comprises a truncated annular body (11) with an opening (13) of slightly smaller dimensions than the diameter of the shank of the stirrer shaft (3), and comprises a central pin (15) in its annular plane for insertion into at least one diametrical machined hole (17) in the shank of the stirrer shaft (3).

4 Claims, 3 Drawing Sheets

HEIGHT LOCATING WASHER FOR THE STIRRER SHAFT OF A STIRRER LID FOR A PAINT STIRRING MACHINE

The invention relates to a height locating washer for the stirrer shaft of a stirrer lid for a paint stirring machine.

The stirrer shaft of stirrer lids on stirring machines is at present located in terms of height by means of a simple annular washer placed in a corresponding groove on the shank of the stirrer shaft. This necessitates relatively careful machining of the shank of the shaft and a corresponding operation of fitting the washer. It is moreover difficult to remove.

The invention aims to solve these problems by proposing a height locating washer for the shank of the stirrer shaft of a stirrer lid for a paint stirring machine, characterized in that it comprises a truncated annular body with an opening of slightly smaller dimensions than the diameter of the shank of the stirrer shaft, and comprises a central pin in its annular plane for insertion into at least one diametrical machined hole in the shank of the stirrer shaft.

Naturally, the washer possesses the property of elastic deformation allowing its opening to be extended to the diameter of the shank of the stirrer shaft for its radial engagement by its central pin on the shank of the stirrer shaft. The length of the central pin may be slightly greater than the diameter of the shank of the stirrer shaft in order to facilitate the insertion of the pin into the said hole in the shank.

The result of this arrangement is that the height of the washer is defined by the engagement of its central pin in the shank of the stirrer shaft, with the annular body of the washer abutting against the barrel of the stirrer lid to enable the stirrer shaft to be located in terms of height relative to the lid.

Fitting the washer is accomplished easily and quickly by radial snap engagement thereof on the shank of the stirrer shaft, and likewise its removal is effected by the reverse operation.

The invention also relates to a stirrer lid fitted therewith.

Figure 1:
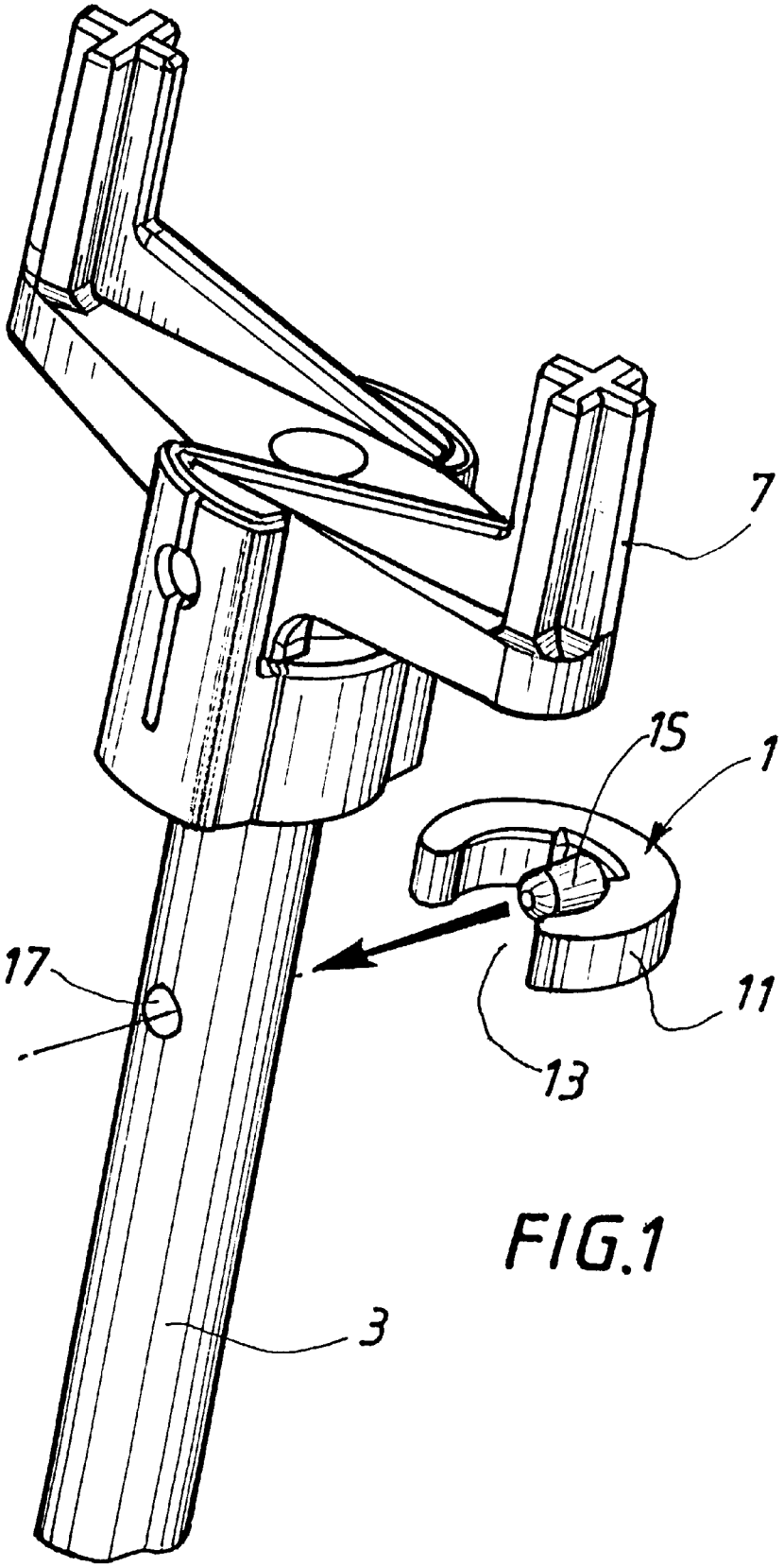
Figure 4:
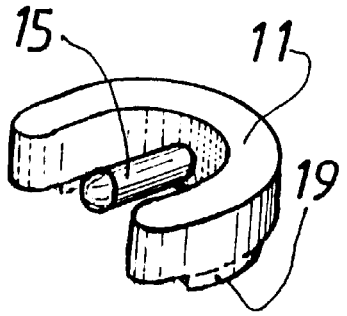
Figure 2:
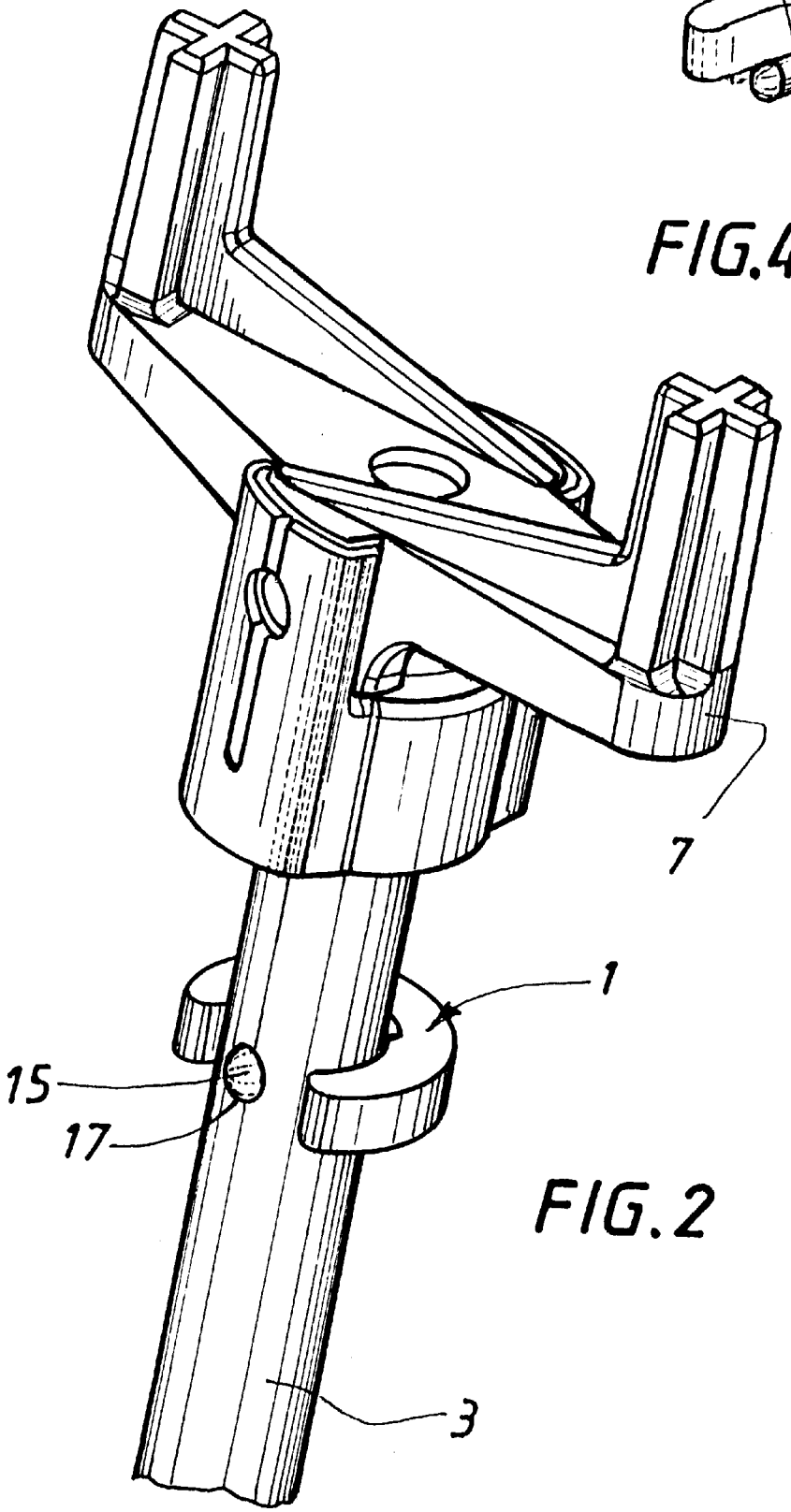
Figure 3:
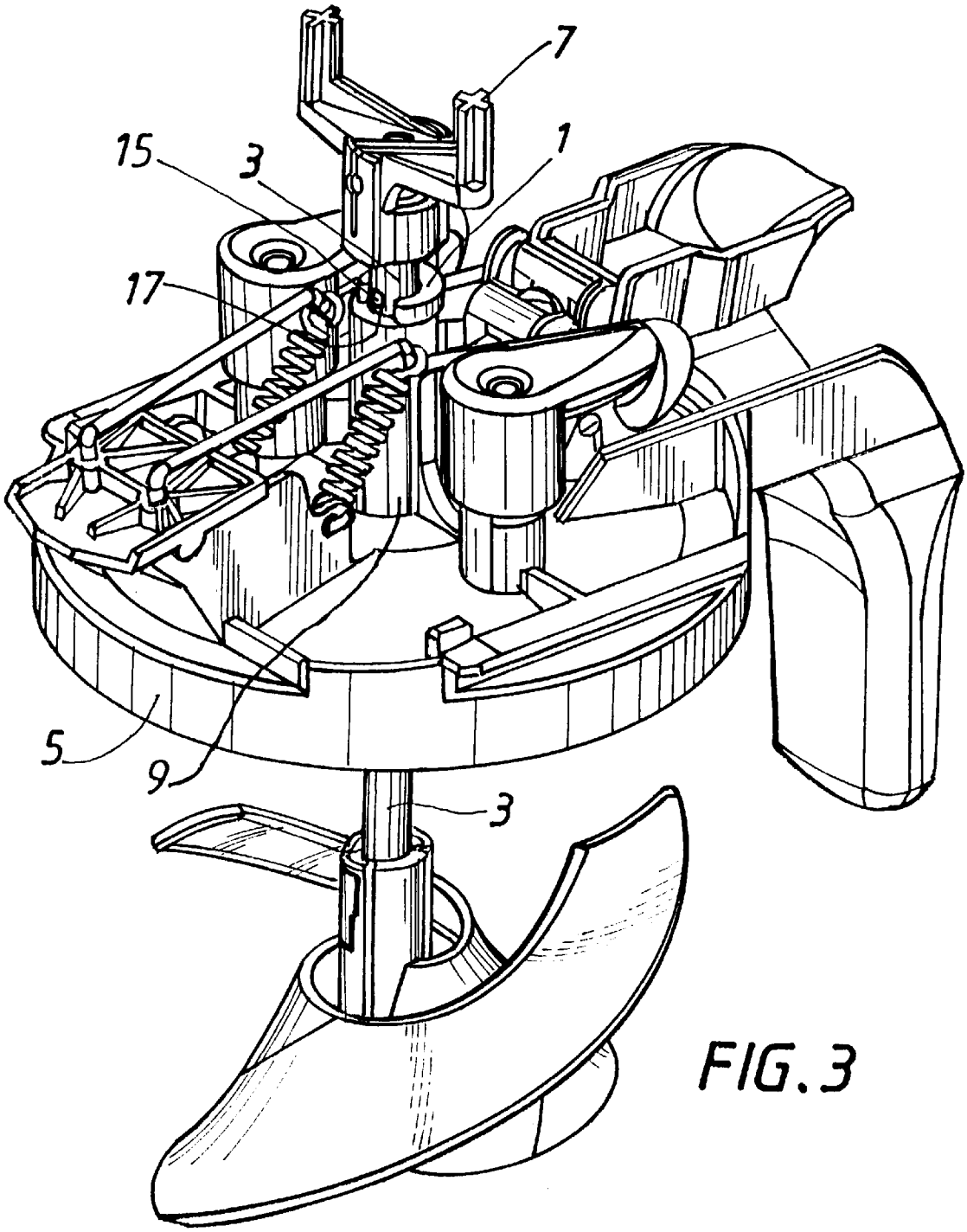

The invention is explained below with the aid of an embodiment and with reference to the accompanying drawings, in which:

FIG. 1 is a perspective view of a washer according to the invention detached from the shank of the stirrer shaft on which it is intended to be fitted, FIG. 2 is a view similar to FIG. 1 showing the washer mounted on the shank of the shaft, FIG. 3 shows a stirrer lid equipped with a washer for locating the stirrer shaft according to the invention, and FIG. 4 is a view of an alternative embodiment.

As shown in the drawings, the shaft washer 1 according to the invention is intended to be fitted to the shank of the stirrer shaft 3 of a stirrer lid 5, on the drive fork 7 of the shaft. It acts as a lower thrust bearing for the shank of the shaft 3 on the barrel 9 of the stirrer lid for its height location as a means of adapting the different heights of paint cans and bladed drive systems of stirring machines.

The washer comprises a truncated annular body 11 with an opening 13 whose width is slightly less than the diameter of the shank of the stirrer shaft 3. It also comprises a central pin 15 located in the plane of the annular body 11 and opposite the opening 13. A machined hole 17 is formed diametrically in the shank of the stirrer shaft 3. This hole 17, which, tolerance aside, is complementary in size to the central pin 15, is designed to receive the central pin 15 of the washer. It is formed at an appropriate height on the shank of the shaft 3 in order that, as stated earlier, the stirrer shaft can be located at the desired height.

The washer is molded from a synthetic material having the property of slight elastic deformation that enables the opening 13 to be deformed to the diameter of the shank of the shaft so that it can be passed around this shaft, while the central pin 15 passes into the hole 17, during fitting of the washer to the shank of this stirrer shaft. The body 11 positions itself perpendicularly to the shank by the clamping action of the washer around the surface of the shank.

Its fitting is thus a simple and rapid snap action, as is its withdrawal by the reverse operation.

The shank of the stirrer shaft may of course comprise several machined holes, enabling the washer to be fitted at different heights on the shank according to the desired location of the stirrer shaft in terms of height.

An alternative embodiment of the invention, as illustrated in FIG. 4, uses diametrically opposite pads 19 on either side of the central pin 15. These pads may be wear pads.

What is claimed is:

1. Height locating system for a stirrer shaft (3) of a stirrer lid (5) for a paint stirring machine, characterized in that said system comprises a stirrer shaft including a washer for a shank of said stirrer shaft, said washer comprising a truncated annular body (11) with an opening (13) of slightly smaller dimensions than the diameter of the shank of the stirrer shaft (3), in that it comprises a central pin (15) in its annular plane for insertion into at least one diametrical machined hold (17) in the shank of the stirrer shaft (3), and in that it possesses the property of elastic deformation allowing its opening (13) to be extended to the diameter of the shank of the stirrer shaft (3) for its radial engagement by its central pin (15) on the shank of the stirrer shaft (3) and its locating on the shaft shank such that the wall of the opening is in close surface contact with the shank of the stirrer lid, perpendicular to the latter, by the clamping action of the body (11) around the surface of the shank (3) and in which the upper and lower of said truncated annular body form bearing surfaces for respectively upper and lower rotary elements supported thereagainst.

2. Shaft locating washer according to claim 1, characterized in that the length of the central pin (15) is slightly greater than the diameter of the shank of the stirrer shaft (3).

3. Shaft locating washer according to one of the preceding claims, characterized in that it comprises diametrically opposite pads (19) on either side of the central pin (15).

4. Stirrer lid, characterized in that it comprises a stirrer shaft (3) provided with a washer (1), as defined according to claim 1 or 2, for its height location, resting on its upper barrel (9).

* * * * *